US006054973A

United States Patent [19]

Hughes et al.

[11] Patent Number: 6,054,973

[45] **Date of Patent: *Apr. 25, 2000**

[54] MATRIX ARRAY BISTABLE DEVICE ADDRESSING

[75] Inventors: Jonathan Rennie Hughes, St. Johns; John Clifford Jones, Malvern; Marie Harper Anderson, Worcestershire, all of United Kingdom

[73] Assignees: Sharp Kabushiki Kaisha, Osaka, Japan; The Secretary of State for Defence in Her Britannic Majesty's Government of the United Kingdom of Great Britain and Northern Ireland, Hants, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,096

[22] Filed: Jun. 3, 1997

[30] Foreign Application Priority Data

Jun. 20, 1996 [GB] United Kingdom ..... 9612958

[51] Int. Cl.[7] ..... G09G 3/36

[52] U.S. Cl. ..... 345/97; 345/98; 345/99

[58] Field of Search ..... 345/94, 95, 96, 345/97, 98, 99; 349/100

[56] References Cited

U.S. PATENT DOCUMENTS

| | | | |
|---|---|---|---|
| 4,574,282 | 3/1986 | Crossland et al. | 345/87 |
| 4,638,310 | 1/1987 | Ayliffe | 340/805 |
| 4,728,947 | 3/1988 | Ayliffe et al. | 345/97 |
| 5,047,758 | 9/1991 | Hartmann et al. | 345/97 |
| 5,128,663 | 7/1992 | Coulson | 345/94 |
| 5,283,564 | 2/1994 | Katakura et al. | 345/87 |
| 5,398,042 | 3/1995 | Hughes | 345/94 |
| 5,404,237 | 4/1995 | Katsuse et al. | 345/97 |
| 5,459,481 | 10/1995 | Tanaka et al. | 345/95 |
| 5,629,718 | 5/1997 | Surguy | 345/99 |
| 5,650,797 | 7/1997 | Okada | 345/97 |

FOREIGN PATENT DOCUMENTS

| | | |
|---|---|---|
| 2230118 | 9/1990 | Japan . |
| 2262831 | 6/1993 | United Kingdom . |
| 9524715 | 9/1995 | WIPO . |

*Primary Examiner*—Dennis-Doon Chow
*Assistant Examiner*—Amr Awad
*Attorney, Agent, or Firm*—Renner Otto Boisselle & Sklar

[57] ABSTRACT

A ferroelectric liquid crystal display comprises a matrix of pixels addressable by first and second sets of electrode tracks crossing one another at the locations of the pixels. The pixels ale addressed by applying data pulses to the first set of electrode tracks and strobe pulses to the second set of electrode tracks to switch certain pixels selected by the data pulses from a first state to a second state under the effect of the voltage difference between the data pulses and the strobe pulses, and blanking pulses are applied to the second set of electrode tracks to set the pixels to the first state in advance of the application of subsequent strobe pulses to switch selected pixels from the first state to the second state. Each blanking pulse includes a blanking portion of one polarity adapted to switch the pixels to a fully switched reunion of the first state and a trailing portion of the opposite polarity adapted to assist relaxation of the pixels from the fully switched region of the first state to a relaxed region of the first state from which rapid switching of pixels to the second state is possible during application of a subsequent strobe pulse.

20 Claims, 3 Drawing Sheets

FIG 5
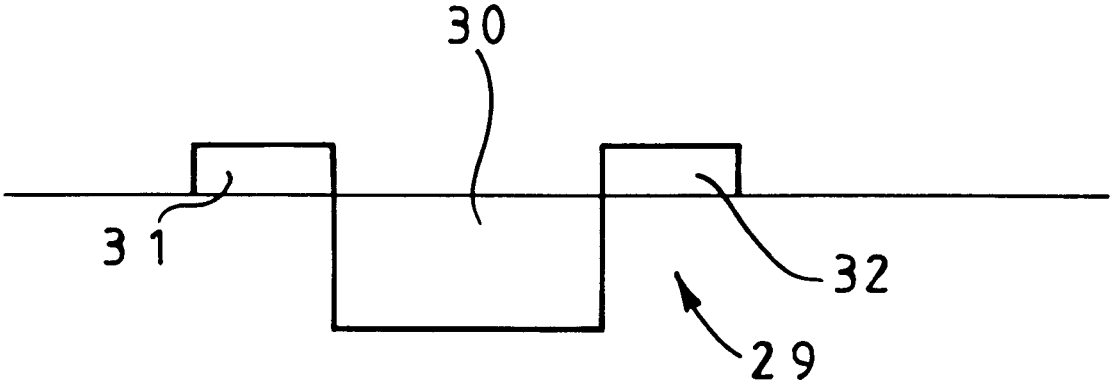
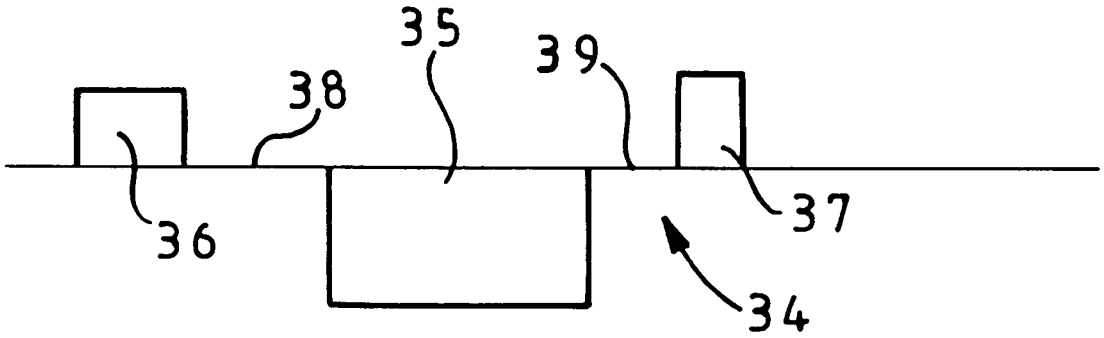
FIG 6

MATRIX ARRAY BISTABLE DEVICE ADDRESSING

This invention relates to the addressing of matrix array bistable devices, such as ferroelectric liquid crystal displays.

BACKGROUND OF THE INVENTION

Liquid crystal devices incorporating a ferroelectric smectic liquid crystal material (FLCDs) are particularly suitable for use in displays and shutters in which their fast switching times and memory characteristics are of advantage. A conventional FLCD comprises a layer of ferroelectric smectic liquid crystal material between two parallel glass substrates, electrode structures being typically provided on the inside facing surfaces of the glass substrates in the form of row and column electrode tracks which cross one another to form a matrix array. As is well known, switching pulses are applied to the row and column electrode tracks in order to produce electric fields which switch the molecules within the material between two polar states having different molecular orientations. As a result of the different light transmitting properties of the two molecular orientations when the material is disposed between two polarisers having polarising axes which are arranged transversely to one another, a display element or pixel at the intersection of two tracks will appear dark or light depending on the state to which the molecules of the pixel have previously been switched by the electric field due to the voltage difference between the pulses applied to the relevant row electrode track on one side of the layer and the relevant column electrode track on the other side of the layer.

Various addressing schemes for controlling such a matrix array FLCD are known, and International Patent Application No. WO 92/02925 discloses a number of such addressing schemes. Typically, in large displays, the display is addressed on a line-by-line basis by applying data pulses in parallel to the column electrode tracks, each data pulse being either an ON pulse (i.e. a switching waveform) or an OFF pulse (i.e. a non-switching waveform), and by sequentially applying a strobe pulse to the row electrode tracks so as to switch selected pixels along each row from one state to the other under the effect of the electric field produced by the voltage difference between the data pulse and the strobe pulse applied to the relevant electrode tracks.

In certain addressing schemes a blanking pulse is applied sequentially to the row electrode tracks which is of such a voltage and duration as to set all the pixels along each row to one state, generally the dark state, irrespective of the data pulses applied to the column electrode tracks. Subsequent application of strobe and data pulses may then be used to switch selected pixels to the other state, generally the light state, whilst leaving the remaining pixels in the one state. Such blanking pulses may be applied on a line-by-line basis ahead of the strobe pulses, or the whole display may be blanked at a time, or a group of lines may be simultaneously blanked. A known blanking scheme uses a blanking pulse of voltage V and duration 2T and having the same product 2VT as, but opposite polarity to, the strobe pulse which has a voltage 2V and a duration T. This ensures that the blanking and strobe pulses are d.c. balanced which is an important requirement to avoid degradation of the display over time.

The advantage of using blanking pulses to switch a line, group of lines or whole display to the dark state before pixels are selectively switched to the light state on a line-by-line basis is that this allows the display to be switched with one strobe pulse frame scan, rather than with two strobe pulse frame scans, one for switching selected pixels to one state and the other for switching selected pixels to the other state, which would result in a lengthy total scan cycle. However a drawback of the blanking pulse scheme is that the pixels are switched fully to one state (usually the dark state) by the blanking pulse, so that those pixels which require to be subsequently switched to the other state during application of a subsequent strobe pulse have to be switched from the fully switched state to the other state, which takes longer than switching from a relaxed state into which the pixels would relax after a suitable delay following removal of the blanking pulse.

As is well known, after removal of the applied electric field, the orientation of the molecules of a pixel will gradually relax into a relaxed state which is close to the fully switched orientation of the molecules so that the pixel still appears dark, but which is part way along the rotational path followed by the director of the molecule during switching into the other state, so that subsequent switching into the other state occurs more rapidly from the relaxed state than it does from the fully switched state. However, if sufficient time is allowed between the blanking pulse and the subsequent strobe pulse to permit the molecules of the pixel to relax into the relaxed state, this provides a significant delay between scanning of a line by a blanking pulse and scanning of the same line by a subsequent strobe pulse, and, if the delay becomes too large, means that a blank line or group of lines becomes visible on the display. Furthermore this will result in a loss of brightness since those pixels which are intended to be in the light state will be in the dark state for a proportion of the addressing cycle. Similarly, if the blanking scheme is such as to switch the pixels to the light state, this will result in a loss of contrast since those pixels which are intended to be in the dark state will be in the light state for a proportion of the addressing cycle.

U.S. Pat. No. 5,283,564 discloses an addressing scheme in which the blanking pulse is followed by a strobe pulse, the strobe pulse having a control phase part followed by a compensation phase part of opposite polarity and synchronised with the corresponding data pulse. The compensation phase part of the strobe pulse serves to increase the temperature margin over which the display presents an acceptable image. However such a compensation phase part does not overcome the problem of the delay between the application of the blanking pulse and the subsequent strobe pulse.

Japanese Published Patent Application No. 2230118A discloses an addressing scheme in which the blanking pulse comprises a resetting part to switch all the pixels to the first state and a partial switching part which then causes all the pixels to incompletely switch to the second state such that the application of the subsequent strobe pulse synchronised with the data pulse enables the addressed pixels to be selectively switched into the first state according to a grey-scale signal to display a half tone. Such an addressing scheme has the object of displaying grey levels in a uniform manner across the display so as to reduce the variation of such grey levels with temperature, etc. This reduction in temperature dependence is due to the fact that the grey level of each pixel is set by partially switching from the first state to the second state and by then returning to the first state, and these two switching operations will tend to compensate for the effects of temperature variation. Such an addressing scheme is not intended to promote rapid switching of the display.

It is an object of the invention to provide an improved method of addressing a matrix array liquid crystal device which allows rapid switching of the device whilst keeping the delay between the application of a blanking pulse and a subsequent strobe pulse relatively short so that it does not adversely affect operation of the device.

SUMMARY OF THE INVENTION

According to the present invention there is provided a method of addressing a matrix array bistable device in which a matrix of pixels is addressable by a first set of electrode tracks on one side of the matrix and a second set of electrode tracks on the other side of the matrix, the first and second sets of electrode tracks crossing one another at the locations of the pixels, the method comprising applying data pulses to the first set of electrode tracks, applying strobe pulses to the second set of electrode tracks to switch certain pixels selected by the data pulses from a first state to a second state under the effect of the electric field produced by the voltage difference between the data pulses and the strobe pulses, and applying blanking pulses to the second set of electrode tracks to set the pixels to the first state in advance of the application of subsequent strobe pulses to switch selected pixels from the first state to the second state, wherein each blanking pulse includes a blanking portion of one polarity adapted to switch the pixels to a fully switched region of the first state and a trailing portion of the opposite polarity adapted to assist relaxation of the pixels front the fully switched region of the first state to a relaxed region of the first state front which rapid switching of pixels to the second state is possible during application of a subsequent strobe pulse.

This method is particularly applicable to the addressing of a liquid crystal device, such as a FLCD, in which the matrix of pixels is provided within a liquid crystal layer.

It will be appreciated that the trailing portion of the blanking pulse in such an addressing scheme assists relaxation of the pixels from the fully switched region to the relaxed region of the same state, rather than causing partial switching to the opposite state as in the case of the greyscale addressing scheme of Japanese Published Patent Application No. 2230118A. Since the trailing portion of the blanking pulse speeds up relaxation of the pixels from the fully switched region to the relaxed region of the first state after removal of the applied electric field at the end of the blanking pulse, relaxation of the pixels to the relaxed region of the first state will occur earlier than would be the case if no such trailing portion were provided. This means that the delay between the end of the blanking pulse and the beginning of the subsequent strobe pulse can be reduced with the result that scanning by the strobe pulse can follow on more closely after the blanking pulse, for example of the order of 5 line address times later. Since the proportion of lines which are blanked at any one time will determine the percentage reduction in brightness of a display due to such blanking assuming blanking to the dark state, this will enable the reduction in brightness of the display due to such blanking to be minimised.

The invention also relates to a matrix array bistable device, such as a ferroelectric liquid crystal display, utilising such an addressing method.

BRIEF DESCRIPTION OF THE DRAWINGS

In order that the invention may be more fully understood, reference will now be made, by way of example, to the accompanying drawings, in which:

FIGS. 5 and 6 are diagrams showing modified blanking pulses used in further embodiments of the invention.

DETAILED DESCRIPTION OF THE DRAWINGS

Figure 1:
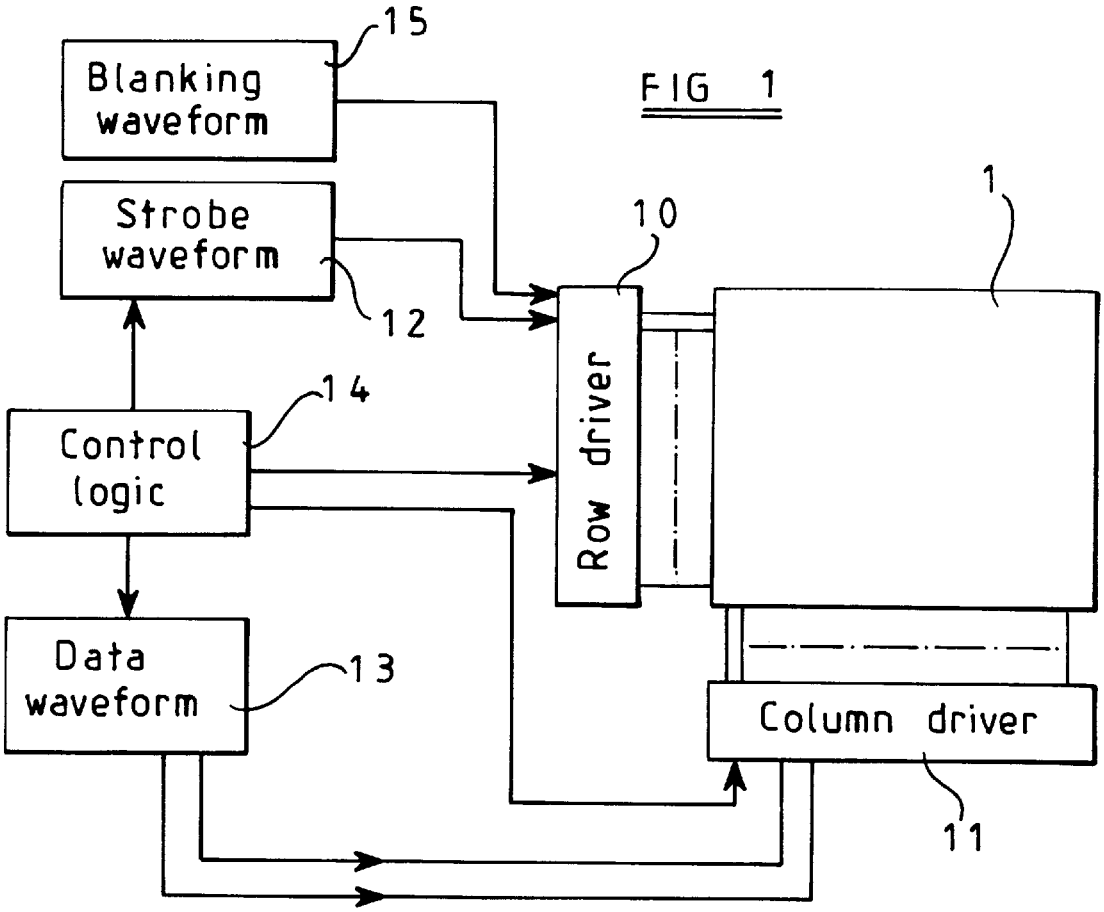
FIG. 1 is a block diagram of a FLCD drive circuit utilised in a preferred embodiment of the invention.
Figure 2:
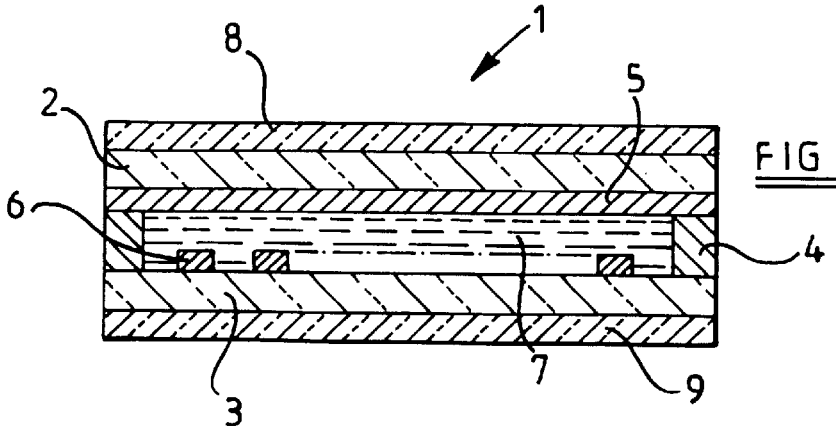
FIG. 2 is a diagrammatic vertical section through a FLCD.

The FLCD 1 shown in FIGS. 1 and 2 comprises a layer 7 of ferroelectric liquid crystal material in the smectic phase contained between two glass substrates 2 and 3 arranged parallel to one another, spaced between 0.5 $\mu$m and 50 $\mu$m apart and sealed at their edges by strips 4. Oppositely facing electrode structures 5 and 6 of transparent tin oxide applied to the inwardly directed faces of the substrates 2 and 3 are in the form of electrode tracks arranged in rows and columns which cross one another to form a matrix array. Pixels within the layer 7 at the intersections of the rows and columns are addressable by the application of suitable strobe and data pulses to the intersecting tracks of the electrode structures 5 and 6. As is well known, the electrode structures may take other forms in further, non-illustrated embodiments of the invention. For example the electrode structures may be in the form of radial and curved tracks in a r, θ display, or in the forms of segments in a numeric display.

Polarisers 8 and 9 are applied to the outer surfaces of the glass substrates 2 and 3, and in addition a thin polymer alignment layer (not shown), for example a polyamide alignment layer, is applied to the inwardly directed face of each electrode structure 5, 6 and is rubbed in a required rubbing direction in the manufacturing process in order to impart a preferred surface alignment direction to the molecules of the layer 7, the rubbing directions of the two alignment layers being parallel or antiparallel to one another.

The switching of the pixels of the display 1 is controlled by row and column drivers 10 and 11, a data pulse generator 13 for supplying ON and OFF data pulses to the column driver 11 so as to apply such pulses in parallel to the column electrode tracks of the electrode structure 5, and a strobe pulse generator 12 for supplying strobe pulses to the row driver 10 so as to apply strobe pulses to the row electrode tracks of the electrode structure 6 sequentially on a line-by-line basis. A blanking pulse generator 15 is provided for supplying blanking pulses to the row driver 10 so as to apply blanking pulses to the row electrode tracks of the electrode structure 6 sequentially on a line-by-line basis, in advance of the strobe pulses. Overall control of timing and display format is provided by a control logic unit 14. It will be understood that the sequential application of the strobe and blanking pulses to the row electrode tracks on a line-by-line basis may be such that the rows are addressed in any convenient order, i.e. not necessarily with adjacent rows being addressed one after the other across the display.

As is well known, application of a blanking pulse to a row electrode track sets all the pixels along the row to the OFF state, that is the dark state, irrespective of the data pulses applied to the column electrode tracks, and a subsequent strobe pulse applied to the row electrode track causes switching of selected pixels along the row to the ON state, that is the light state, according to which pixels are controlled to the ON state by the application of ON data pulses to the corresponding column electrode tracks. Those pixels corresponding to column electrode tracks to which OFF data pulses are applied will remain in the OFF state, that is the dark state. In each case the voltage difference between the strobe and data pulses results in an electric field being applied across the layer so as to act on the molecules in the layer in such a manner as to switch the molecules to the other stable state or to retain the molecules in the same state, as the case may be.

Figure 3:
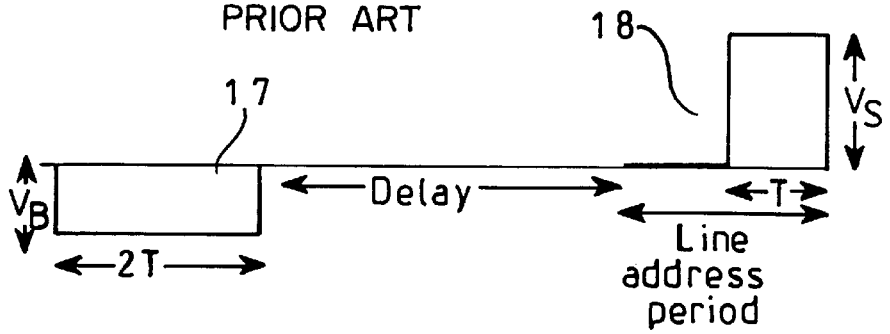
FIG 3 PRIOR ART
FIG. 3 is a diagram showing a blanking pulse followed by a strobe pulse in a known blanking scheme.

FIG. 3 shows a conventional blanking scheme in which a negative polarity blanking pulse 17 of voltage $V_B$ and duration 2T precedes the strobe pulse 18 having a zero voltage portion of duration T and a positive polarity portion of voltage $V_S$ and duration T. In order to maintain d.c. balance $V_S=2V_B$. After all the pixels along a row have been switched to the fully OFF state, that is the dark state, a sufficient delay is provided to allow the pixels to relax to the relaxed region of that state, and after the delay the strobe pulse 18 switches selected pixels to the ON state in accordance with the data pulses applied to the columns over a line address period 2T, the switching speed being enhanced by the fact that the pixels had previously been allowed to relax to the relaxed region of the OFF state. However, if the delay becomes too large, the blank line or group of lines becomes visible on the display.

Figure 4:
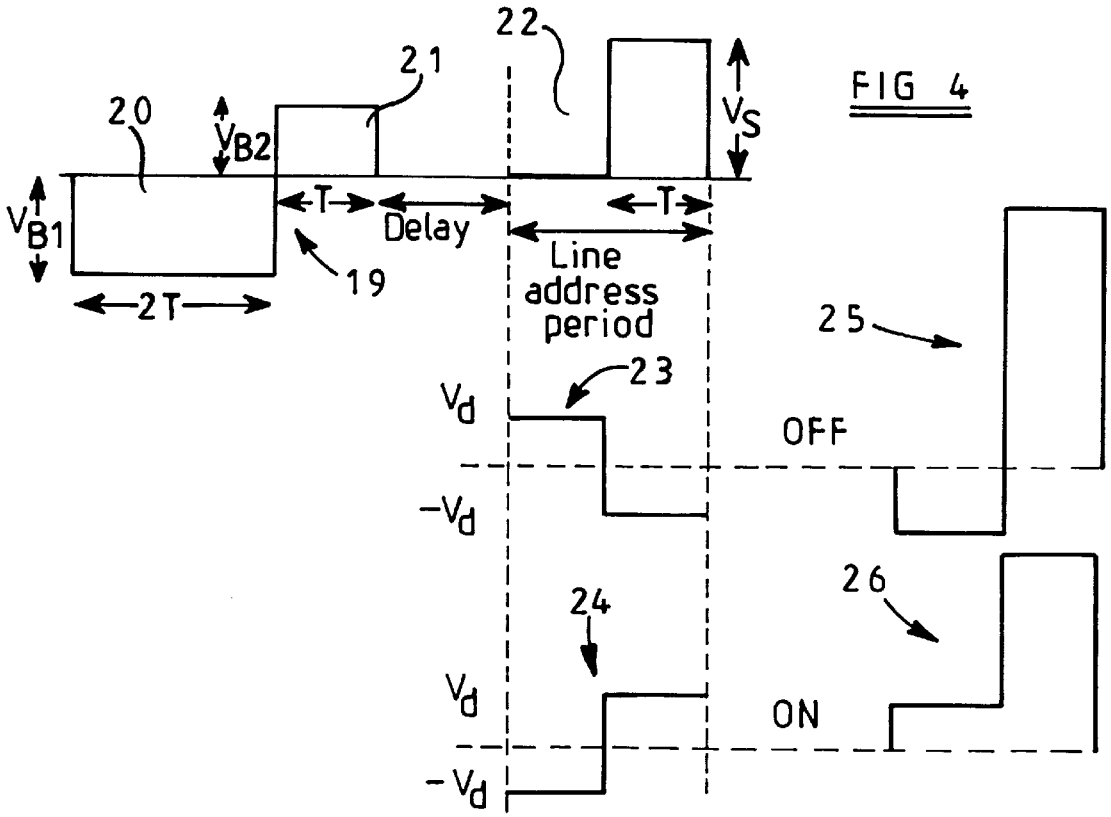
FIG. 4 is a diagram showing a blanking pulse followed by a strobe pulse in a blanking scheme used in the preferred embodiment of the invention, together with the associated data and resultant waveforms.

In order to overcome this disadvantage, the invention proposes a new blanking scheme of which an exemplary embodiment is shown in FIG. 4. In the exemplary blanking scheme of FIG. 4, which is applicable to a τV minimum mode of addressing (as described in J. C. Jones, "Exploiting the Minimum", Information Display, Vol. 12, No. 2, pp. 12–15), the blanking pulse 19 has a negative polarity blanking portion 20 having a voltage $V_{B1}$ and duration 2T immediately followed by a positive polarity trailing portion 21 having a voltage $B_{B2}$ and a duration T. In order to maintain d.c. balance $V_S=2V_{B2}$, $V_{B1}=1.5V_{B2}$. The effect of the trailing portion 21 of the blanking pulse 19 is to speed up relaxation of the pixels after they have been set to the fully OFF state, that is the dark state, by the blanking portion 20 of the blanking pulse 19, whilst ensuring that none of the pixels is switched to the ON state by the trailing portion 21. As a result the time delay required for relaxation of the pixels is reduced, and the blanking pulse 19 can be followed more closely by the strobe pulse 22 whilst still obtaining the desirable effect of fast switching due to the fact that those pixels which are switched to the ON state by the strobe pulse 22, require to be switched only from the relaxed region of the OFF state.

The manner in which the data and strobe pulses supplied to particular column and row electrode tracks determine the switching state of a pixel will now be briefly described in a non-limiting example. During the line address period of duration 2T, the strobe pulse 22 is applied in synchronism with either an OFF data pulse 23 or an ON data pulse 24 so that the resultant voltage across the pixel determines the state of the pixel, that is whether the pixel is in the OFF state or the ON state. When the OFF data pulse 23 is applied, the resultant voltage 25 across the pixel causes the pixel to remain in the same state, that is the state to which the pixel has previously been blanked by the blanking pulse 19. When the ON data pulse 24 is applied, the resultant voltage 26 across the pixel causes the pixel to switch to the opposite state. In the particular example given the pixel is switched by the blanking pulse 19 to the dark state, in which case the OFF data pulse 23 results in the pixel remaining in the dark state, whereas the ON data pulse 24 results in switching of the pixel to the light state. However, in an alternative embodiment the blanking pulse may be adapted to switch the pixel to the light state.

In certain circumstances it may be necessary to increase the voltage or duration of the blanking portion 20 of the blanking pulse 19 in order to obtain optimum blanking, or alternatively it may be necessary to decrease the voltage or duration of the trailing portion 21 of the blanking pulse 19 in order to ensure that it does not cause switching of pixels into the ON state. Accordingly, in a modified blanking scheme in accordance with the invention, as shown in FIG. 5, the blanking portion 30 of the blanking pulse 29 may be preceded immediately by a positive polarity leading portion 31 with the object of maintaining d.c. balance, that is so that the voltage duration product of the blanking portion 30 of the blanking pulse 29 is offset by the sum of the voltage duration products of the leading and trailing portions 31 and 32 of the blanking pulse 29 and the following strobe pulse (not shown in FIG. 5).

Although, in the examples described, the blanking portion of the blanking pulse is immediately followed by the trailing portion, it is also possible for the blanking portion and the trailing portion to be separated by an interval in which the voltage is substantially zero. Furthermore it is also possible for the leading portion of the blanking pulse and the blanking portion to be separated by an interval in which the voltage is substantially zero. FIG. 6 shows a blanking pulse 34 usable in a further blanking scheme in which both such zero voltage intervals are provided on the two sides of the blanking portion 35. As shown in this figure, the two intervals 38 and 39 may be of different duration, and additionally the leading and trailing portions 36 and 37 may be of different voltages and durations. Furthermore, although both the duration of the blanking pulse and the length of the delay before application of the strobe pulse will generally be an integral number of time slots, it is also possible for these two periods to be varied in smaller increments.

What is claimed is:

1. A method of addressing a matrix array bistable device in which a matrix of pixels is addressable by a first set of electrode tracks on one side of the matrix and a second set of electrode tracks on the other side of the matrix, the first and second sets of electrode tracks crossing one another at the locations of the pixels, the method comprising:

applying data pulses to the first set of electrode tracks, applying strobe pulses to the second set of electrode tracks to switch certain pixels selected by the data pulses, during select periods for each of the pixels defined by simultaneous application of a data pulse and a strobe pulse to the pixel, from a first state to a second state under the effect of the electric field produced by the voltage difference between the data pulses and the strobe pulses, and applying blanking pulses to the second set of electrode tracks to set the pixels to the first state in advance of the application of subsequent strobe pulses during the select periods to switch selected pixels from the first state to the second state, each blanking pulse being applied between successive select periods for each of the pixels and including a blanking portion of one polarity adapted to switch the pixels to a fully switched region of the first state and a trailing portion of the opposite polarity adapted to assist relaxation of the pixels, in advance of a subsequent select period, from the fully switched region of the first state to a relaxed region of the first state from which rapid switching of pixels to the second state is possible during application of the subsequent strobe pulse.

2. A method according to claim 1, wherein the leading edge of the trailing portion of the blanking pulse follows the trailing edge of the blanking portion of the blanking pulse either immediately or after an interval in which the voltage of the blanking pulse is substantially zero.

3. A method according to claim 1, wherein the sum of the voltage/duration products of the blanking portion, the trailing portion and the strobe pulse is substantially equal to zero, in order to provide d.c. balance.

4. A method according to claim 1, wherein the blanking portion of the blanking pulse is of significantly greater duration than the strobe pulse and of significantly lesser voltage than the strobe pulse.

5. A method according to claim 1, wherein the trailing portion of the blanking pulse is of significantly lesser duration and voltage than the blanking portion of the blanking pulse.

6. A method according to claim 1, wherein the duration of the trailing portion of the blanking pulse is approximately half the duration of the blanking portion of the blanking pulse.

7. A method according to claim 1, wherein the voltage of the trailing portion of the blanking pulse is approximately half the voltage of the strobe pulse.

8. A method according to claim 1, wherein each blanking pulse has a leading portion which precedes the blanking portion either immediately or by a small interval in which the voltage of the blanking pulse is substantially zero, such that the sum of the voltage/duration products of the blanking portion, the leading portion, the trailing portion and the strobe pulse is substantially equal to zero, in order to provide d.c. balance.

9. A method according to claim 1, wherein the strobe and blanking pulses are applied to the second set of electrode tracks sequentially over a frame scanning period with the strobe pulses leading the blanking pulses by a predetermined period which is significantly less than the frame scanning period.

10. A method according to claim 1, wherein the trailing portion of the blanking pulse and the subsequent strobe pulse are separated by a delay to enable relaxation of the pixels.

11. A matrix array bistable device comprising:

an addressable matrix of pixels, a first set of electrode tracks on one side of the matrix, a second set of electrode tracks on the other side of the matrix, the first and second sets of electrode tracks crossing one another at the locations of the pixels, data pulse means for applying data pulses to the first set of electrode tracks, strobe pulse means for applying strobe pulses to the second set of electrode tracks to switch certain pixels selected by the data pulses, during select periods for each of the pixels defined by simultaneous application of a data pulse and a strobe pulse, from a first state to a second state under the effect of the electric field produced by the voltage difference between the data pulses and the strobe pulses, and blanking pulse means for applying blanking pulses to the second set of electrode tracks to set the pixels to the first state in advance of the application of subsequent strobe pulses during the select periods to switch selected pixels from the first state to the second state, wherein each blanking pulse is applied between successive select periods for each of the pixels and includes a blanking portion of one polarity adapted to switch the pixels to a fully switched region of the first state and a trailing portion of opposite polarity adapted to assist relaxation of the pixels, in advance of a subsequent select period, from the fully switched region of the first state to a relaxed region of the first state from which rapid switching of pixels to the second state is possible during application of the subsequent strobe pulse.

12. A device according to claim 11, wherein the leading edge of the trailing portion of the blanking pulse follows the trailing edge of the blanking portion of the blanking pulse either immediately or after an interval in which the voltage of the blanking pulse is substantially zero.

13. A device according to claim 11, wherein the sum of the voltage/duration products of the blanking portion, the trailing portion and the strobe pulse is substantially equal to zero, in order to provide d.c. balance.

14. A device according to claim 11, wherein the blanking portion of the blanking pulse is of significantly greater duration than the strobe pulse and of significantly lesser voltage than the strobe pulse.

15. A device according to claim 11, wherein the trailing portion of the blanking pulse is of significantly lesser duration and voltage than the blanking portion of the blanking pulse.

16. A device according to claim 11, wherein the duration of the trailing portion of the blanking pulse is approximately half the duration of the blanking portion of the blanking pulse.

17. A device according to claim 11, wherein the voltage of the trailing portion of the blanking pulse is approximately half the voltage of the strobe pulse.

18. A device according to claim 11, wherein each blanking pulse has a leading portion which precedes the blanking portion either immediately or by a small interval in which the voltage of the blanking pulse is substantially zero, such that the sum of the voltage/duration products of the blanking portion, the leading portion, the trailing portion and the strobe pulse is substantially equal to zero, in order to provide d.c. balance.

19. A device according to claim 11, wherein the strobe and blanking pulses are applied to the second set of electrode tracks sequentially over a frame scanning period with the strobe pulses leading the blanking pulses by a predetermined period which is significantly less than the frame scanning period.

20. A device according to claim 11, wherein the trailing portion of the blanking pulse and the subsequent strobe pulse are separated by a delay to enable relaxation of the pixels.

* * * * *